US006298863B1

(12) United States Patent
Byun

(10) Patent No.: US 6,298,863 B1
(45) Date of Patent: Oct. 9, 2001

(54) COSMETIC CASE HAVING A BRUSH WITH A SLIDING CAP

(76) Inventor: Young Kwang Byun, MokdongSinsigaji Apt. 928-1005, 312, Shinjung-dong, Yangchun-gu, Seoul (KR)

( * ) Notice: Subject to any disclaimer, the term of this patent is extended or adjusted under 35 U.S.C. 154(b) by 0 days.

(21) Appl. No.: 09/693,164

(22) Filed: Oct. 23, 2000

(30) Foreign Application Priority Data

Jul. 25, 2000 (KR) ..... 00-21237

(51) Int. Cl.[7] ..... A45D 33/28

(52) U.S. Cl. ..... 132/294; 132/313; 132/314; 132/317; 401/125

(58) Field of Search ..... 132/287, 290, 132/293, 294, 295, 297, 301, 313, 314, 315, 317; 401/123, 124, 125; 206/581, 361; 220/736, 833, 834, 835, 324, 212, 503

(56) References Cited

U.S. PATENT DOCUMENTS 4,579,133 * 4/1986 Seidler ..... 132/85
4,726,387 * 2/1988 Sarica ..... 132/85
5,107,984 * 4/1992 Welschoff ..... 206/45
5,669,400 * 9/1997 Sheffler et al. ..... 132/295
5,836,319 * 11/1998 Lombardi ..... 132/287
5,906,214 * 5/1999 Gueret ..... 132/314

* cited by examiner

*Primary Examiner*—Todd E. Manahan
*Assistant Examiner*—David C Comstock
(74) *Attorney, Agent, or Firm*—Ezra Sutton

(57) ABSTRACT

A cosmetic case comprises a body having a hollow portion formed at an upper portion thereof for containing a certain amount of cosmetic material and a brush storage hole formed inwardly at a lower portion thereof for storing a brush; a cover hinged at one side on the upper portion of the body to open and shut the body, the cover having a transparent window located at the center thereof for displaying the inside of the body containing the cosmetic material and a grip insertion groove formed at the other side of the cover opposed to the hinged portion; and a brush having a protective cap for wrapping and protecting a hair part and a grip part, the protective cap moving back and forth wrapping the hair part and the grip part, the brush being stored in the brush storage hole of the body and collapsed at a portion thereof, the collapsed end of the brush being forcedly inserted into the grip insertion groove of the cover to couple the cover and the body. According to the present invention, since the hair part of the brush is removably inserted into the brush hole in the state that the hair part is wrapped with the protective cap, the hair part of the brush is protected from being wider or bending.

3 Claims, 5 Drawing Sheets

COSMETIC CASE HAVING A BRUSH WITH A SLIDING CAP

BACKGROUND OF THE INVENTION

1. Field of the Invention

The present invention relates to a cosmetic case having a brush, and more particularly, to a cosmetic case a cover of which can be easily fastened using a collapsible brush and which prevents a hair part of the brush removably inserted into a case body from bending or becoming wider.

Especially, the cosmetic case of the present invention includes the brush for making up on a wide area of a user's face on which blusher and powder are worn, the brush being removably inserted into the case without transformation of the hair part of the brush.

2. Description of the Related Art

In general, cosmetics, which are women's daily necessities, are put in a compact case and carried with a user.

That is, cosmetic cases are manufactured in consideration of women's esthetic taste and manufactured in a small size to be contained in a small space such as a handbag, so that it is convenient in carrying.

Therefore, convenience in carrying is the main cause of product selling. In the maximum reflection of the above, presently, cosmetics manufacturers are developing small and convenient cosmetic cases with development of cosmetics.

Such typical cosmetic case includes a body and a cover fit with the body. Between the body and the cover, formed is a hollow portion, in which cosmetic material and a brush used for wearing the cosmetic material on a user's face are contained.

Here, one side of the cover is hinged on the body and the other side of the cover has coupling means allowing the cover to be detachably mounted when the case is opened and shut.

Usually, the coupling means consists of a button projected sideways from the cover or the body and a clamp, which moves back and forth by the button for simultaneously locking the cover and the body by the user's manipulation.

When the user pushes the button, the clamp is released from a locked state and thereby the cover is opened, so that the user can paints the cosmetic material on the face using the brush contained in the case body.

However, the conventional cosmetic case, because of the complex coupling means consisting of the button and the clamp, has several problems that the coupling means disposed in a narrow space in which the cover and the cosmetic material are contacted causes an increase of the manufacturing cost and the frequent opening of the cover may damage the complex coupling means. Moreover, when pressing the button to open the cover, the user may drop the cosmetic case and thereby the case may be broken, and the cosmetic case may be opened unintentionally during carrying.

Furthermore, as the brush contained within the case body with the cosmetic material, because of restriction of size of the case body, is manufactured in a small size, it is very inconvenient in use and moves within the case body or bumps against the case body to cause noise and damage during carrying the cosmetic case. At this time, the brush comes to be stained with the cosmetic material and it makes the inside of the case body and the cosmetics material dirty.

To solve the problems, an application is illustrated in Korean Utility Model Appln. No. 1999-25705, filed on Nov. 22, 1999 and invented by the same inventor of the present invention. In the application, it is described that a brush storage part is formed in a case body for removably inserting a brush into the case body to prevent the movement of the brush and the contamination of cosmetic material due to the movement of the brush. However, in case of a brush made of not sponge but hair, when the brush is inserted into the brush storage part, the hair part may be wider or bend. Especially, a thick-haired brush, which is used for making up on a wide area on which blusher and power are worn, when inserted into the brush storage part, may have lots of hairs bent or wider, thereby being damaged not to use.

SUMMARY OF THE INVENTION

It is, therefore, an object of the present invention to provide a cosmetic case, in which a hair part of a brush is removably inserted into a brush storage hole in a state that the hair part is wrapped with a protective cap, so that it is prevented that the hair part of the brush becomes wider or bend.

That is, the object of the present invention is to protect a thick-haired brush, which are removably inserted into the cosmetic case, used for blusher and power and to make it perform its function sufficiently.

To achieve the object, the present invention provides a cosmetic case comprising: a body having a hollow portion formed at an upper portion thereof for containing a certain amount of cosmetic material and a brush storage hole formed inwardly at a lower portion thereof for storing a brush; a cover hinged at one side on the upper portion of the body to open and shut the body, the cover having a transparent window located at the center thereof for displaying the inside of the body containing the cosmetic material and a grip insertion groove formed at the other side of the cover opposed to the hinged portion; and a brush having a protective cap for wrapping and protecting a hair part and a grip part, the protective cap moving back and forth wrapping the hair part and the grip part, the brush being stored in the brush storage hole of the body and collapsed at a portion thereof, the collapsed end of the brush being forcedly inserted into the grip insertion groove of the cover to couple the cover and the body.

In the cosmetic case according to the present invention, it is preferable that the brush includes a lower grip part and an upper grip part, and the lower grip part has an end portion where the hair part is fixed and the other end portion where the upper grip part for coupling the cover and the body is hinged, and wherein the protective cap of the brush moves back and forth wrapping the hair part and the grip part to protect the hair part when the brush is inserted into the brush storage hole.

In the cosmetic case according to the present invention, it is preferable that the grip part has a guide groove formed longitudinally and the protective cap has a guide protrusion formed inside of the protective cap and inserted into the guide groove of the grip part to lead a straight movement of the protective cap.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in connection with preferred embodiments with reference to the accompanying drawings.

Figure 1:
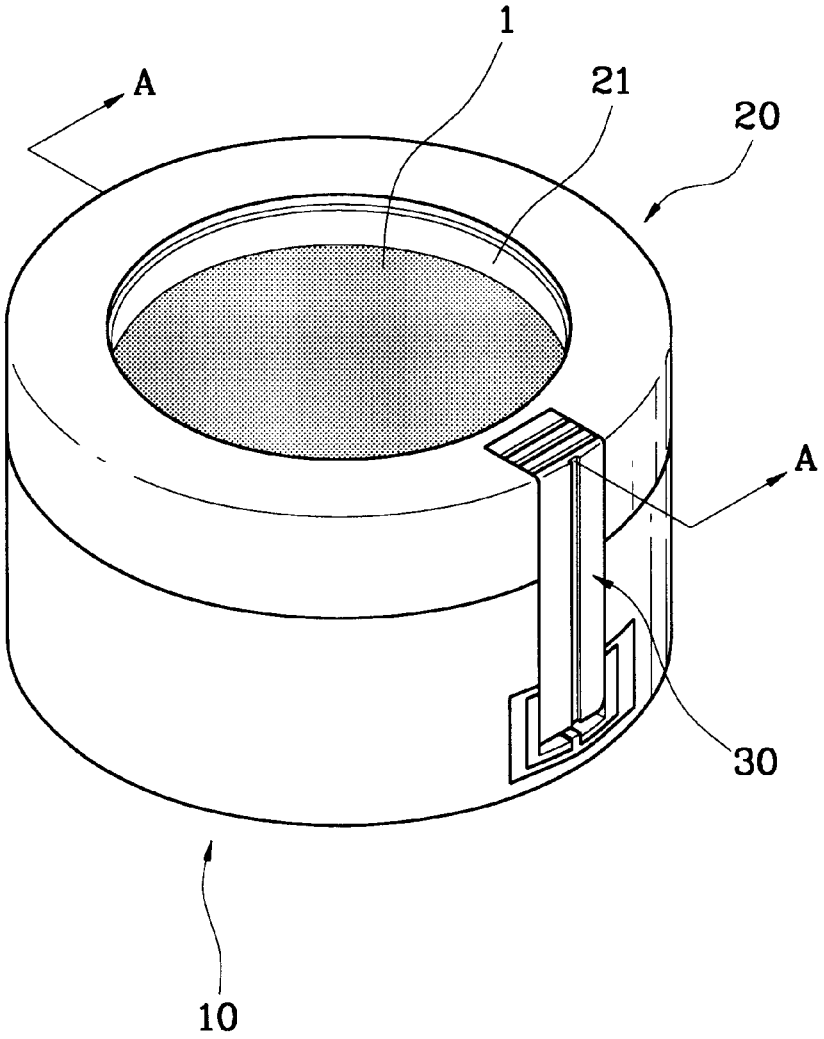
FIG. 1 is a perspective view of a cosmetic case according to the present invention.

Referring to FIG. 1, a cosmetic case according to the present invention includes a body 10 containing cosmetic material 1 such as blusher or powder, a cover 20 for covering the body 10 and a brush 30 having a hair part for painting the cosmetic material 1 on a user's face and coupling the body 10 and the cover 20.

After separating the brush 30 from the body 10, pulling a protective cap and opening the cover 20, the user paints the cosmetic material contained in the body 10 on the face using the brush 30.

Figure 2:
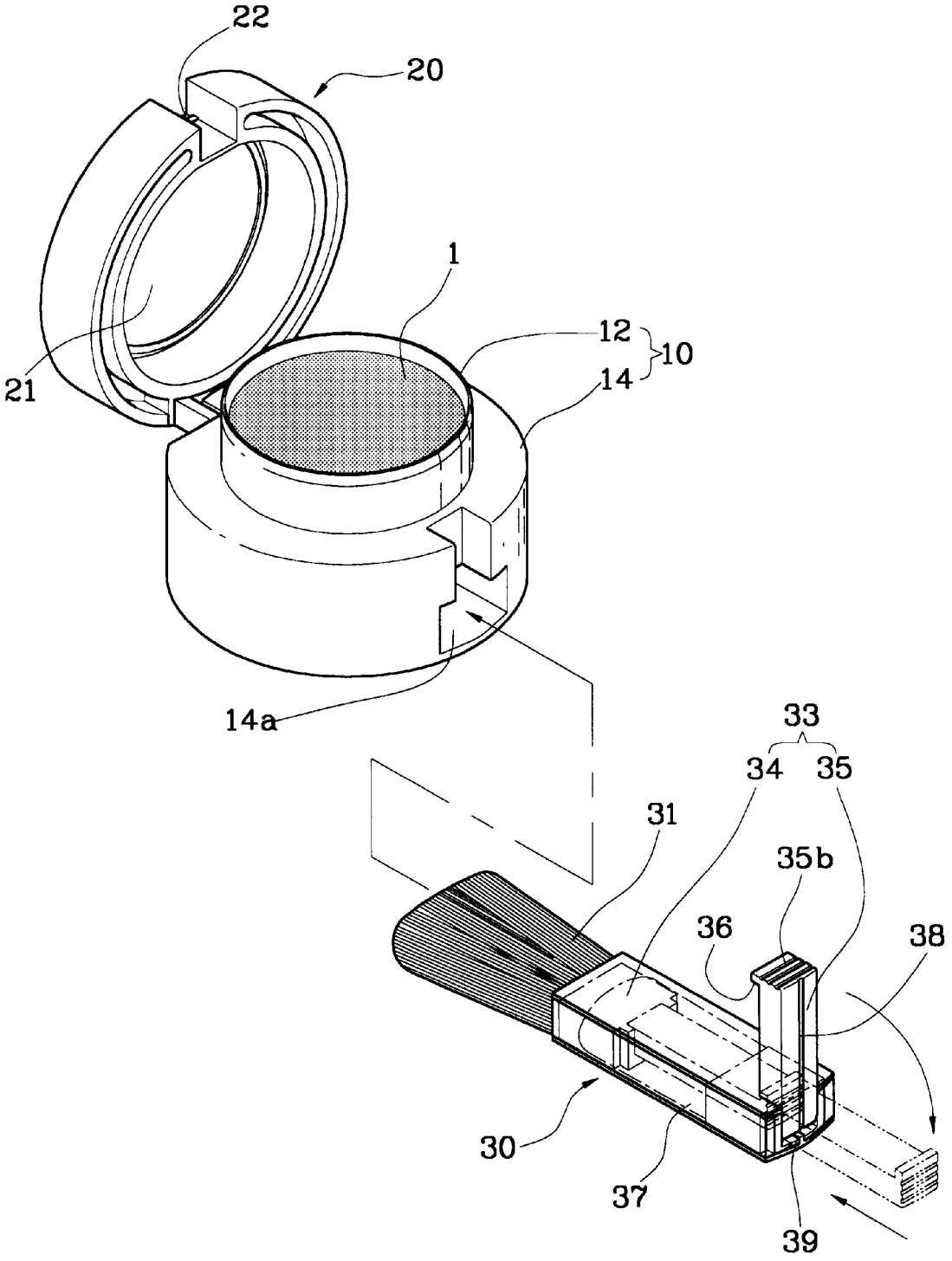
FIG. 2 is an exploded perspective view of the cosmetic case according to the present invention.

As shown in FIG. 2, the body 10 includes a cosmetic material storage part 12, in which a hollow portion is formed for containing a certain amount of cosmetic material 1, and a brush storage part 14 having a brush storage hole 14*a* for removably inserting the brush 30 sideways. The hollow portion of the cosmetic material storage part 12 is opened upward and the brush storage hole 14*a* is formed at a lower portion of the cosmetic material storage part 12.

Here, it is preferable that the cosmetic material storage part 12 and the brush storage part 14 are made as one body. The cosmetic material 1 may be one of various cosmetic materials used for powder, blusher or the likes.

Furthermore, the cover 20 is hinged at one side on the upper portion of the body 10 and seals the hollow portion of the body 10 by contacting with the body 10. The cover 20 includes a transparent window 21 at the center thereof to display the cosmetic material 1 contained in the body 10 and a grip insertion groove 22 formed at the other side thereof.

Here, in place of the transparent window 21, a small-sized mirror may be disposed on an inner wall of the cover 20.

Figure 3:
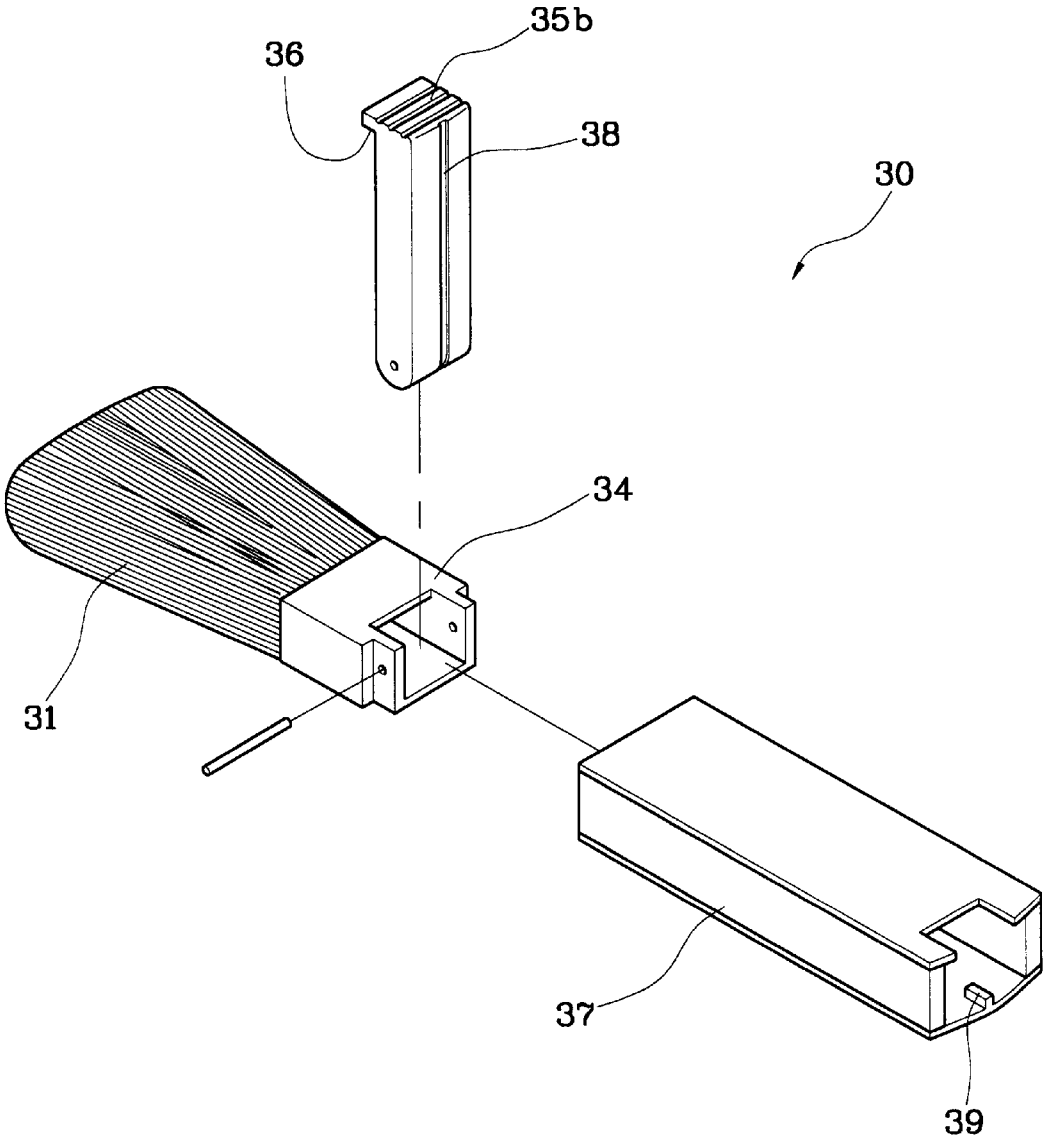
FIG. 3 is an exploded perspective view showing a brush shown in FIG. 2, in more detail.

As shown in FIG. 3, the brush 30 includes a hair part 31 for painting the cosmetic material 1 on the face, a grip part 33 connected to the hair part 31 and a protective cap 37 for wrapping up the hair part 31.

Here, the hair part 31 for painting the powder or the blusher on the face is fixed to an end of the grip part 33. The grip part 33 includes a lower grip part 34, which is inserted and fit into the brush storage hole 14*a* formed at the side of the body 10 in state of being wrapped with protective cap 37, and an upper grip part 35 hinged to the lower grip part 34. The upper grip part 35 is collapsed from the lower grip part 34 in the form of "¬" and inserted and fit into the grip insertion groove 22 of the cover 20.

The protective cap 37 wrapping up the hair part 31 and the lower grip part 34 has the same shape and length as the brush storage hole 14*a* to be inserted into the brush storage hole 14*a*. The length of the protective cap 37 is equal with that of the hair part 31 and the lower grip part 34 or that of the lower grip part 34 and the upper grip part 35. That is, the length of the protective cap 37 is made in such a manner that the upper grip part 35 can be collapsed in the form of "¬" when the protective cap 37 wraps the hair part 31 and the hair part 31 is entirely exposed when the upper grip part 35 is stretched in a straight line and the protective cap 37 is moved backward.

Additionally, one side of the cover 20 is hinged on the upper portion of the body 10 and the other side of the cover 20 opposed to the hinged portion has the grip insertion groove 22 for inserting the upper grip part 35.

Meanwhile, when the cover 20 is opened, the grip part 33 of the brush 30, in which the lower grip part 34 and the upper grip part 35 are collapsibly hinged on each other, is separated from the brush storage hole 14*a* and stretched in a straight line, so that the user can easily grasp it with hand.

Because the protective cap 37 fixes and wraps the lower grip part 34 and the upper grip part 35 when moving backward, the grip part 33 is not collapsed so as for the user to easily put on the makeup using the hair part 31.

Moreover, the grip part 33 has a guide groove 38 elongated longitudinally and the protective cap 37 has a guide protrusion 39 formed inside the protective cap 37. The guide protrusion 39 of the protective cap 37 is inserted into the guide groove 38 of the grip part 33 to lead a straight movement of the protective cap 37 and to fasten the upper grip part 35 not to move within the protective cap 37.

Figure 4:
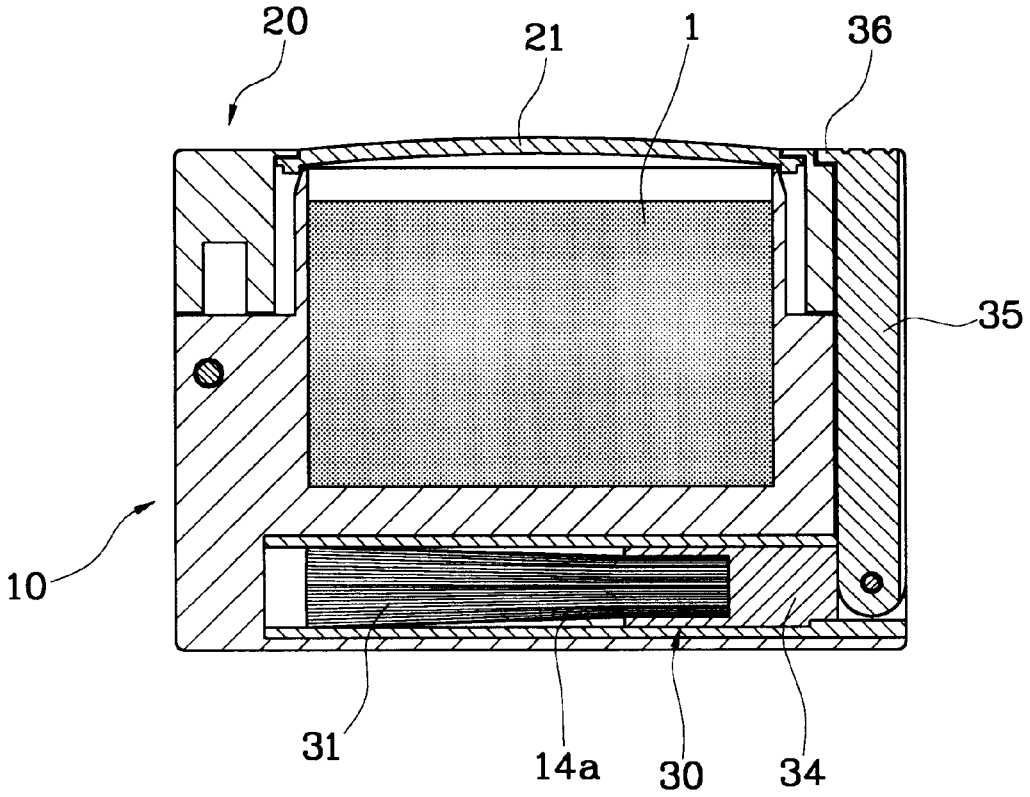
FIG. 4 is a sectional view taken along the line A—A of FIG. 1.
Figure 5:
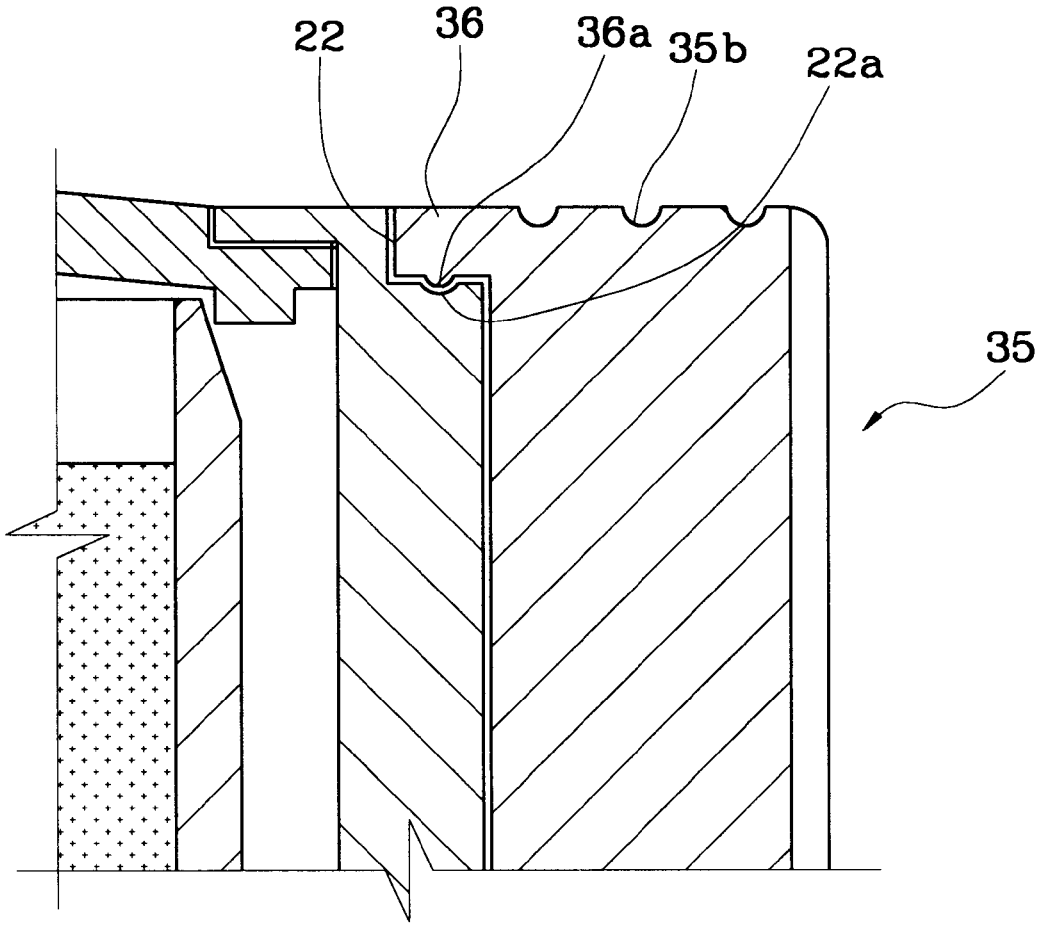
FIG. 5 is a partial enlarged sectional view showing a state that a cover and an upper grip part of FIG. 4 are assembled.

As shown in FIGS. 4 and 5, the upper grip part 35 of the grip part 33 has a latched jaw 36 horizontally projected to prevent the separation of the cover 20.

Here, the grip insertion groove 22 of the cover 20, in which the latched jaw 36 is inserted, has the corresponding shape of the latched jaw 36 to engage each other. The latched jaw 36 has a protrusion 36*a* and the grip insertion groove 22 has a groove 22*a*, which have the corresponding shape and are formed in the corresponding location. The protrusion 36*a* and the groove 22*a* forcedly engage each other, and unless pressed by external force, the engaging state can be kept.

Furthermore, a wrinkle part 35*b* is formed on the external surface of the upper grip part 35 for preventing a slip, so that the user can easily push and separate the upper grip part 35, which is inserted into the grip insertion groove 22, from the grip insertion groove 22.

Here, it is possible that a coarsely treated surface or protrusions may be formed in place of the wrinkle part 35*b*.

Therefore, when the user grasps the body 10 with one hand and pushes the wrinkle part 35*b* of the upper grip part 35 with the other hand, the upper grip part 35 is separated from the grip insertion groove 22 of the cover 20 and thereby the cover 20 is opened freely. After opening the cover 20 and stretching the upper grip part 35 to be in a straight line with the lower grip part 34, the user moves backward the protective cap 37. When the lower grip part 34 and the upper grip part 35 are fixed inside of the protective cap 37, the user takes out the hair part 31 stored in the brush storage hole 14*a* and paints the cosmetic material 1 contained in the body 10 on the face using the hair part 31.

At this time, the user grasps the protective cap 37, which wraps up the grip part 33 consisting of the lower grip part 34 and the upper grip part 35, with hand. The upper grip part 35 serves not only to fix the cover 20 on the body 10 but also to make the use of the brush easy as a portion of the grip part 33 supporting the protective cap 37.

Therefore, the cosmetic case according to the present invention has a simple structure having the upper grip part 35 of insertion type, thereby being easy in design and manufacture. Additionally, the cosmetic case has an excellent durability even in frequent opening of the cover 20 because of the strong structure. The motion that the user grasps the body 10 with one hand and grasps the protective cap 37 wrapping the upper grip part 35 with the other hand is so stable that the cosmetic case can be prevented from dropping.

Moreover, since the upper grip part 35 is forcedly inserted into the grip insertion groove 22 and the lower grip part 34 together with the protective cap 37 is inserted into the brush storage hole 14*a*, the cover 20 is not opened unintentionally during carrying.

Additionally, because only a portion of the brush 30 is stored in the body 10 in separation from the cosmetic material 1, the size of the brush 30 is less restricted to that of the body 10 compared with the conventional cosmetic case. Therefore, the brush 30 may be manufactured in an appropriate size suitable for use and the body 10 can effectively contain the cosmetic material even in a small space since the brush 30 does not occupy the space larger than the need. Since the cover 20, the body 10 and the brush 30 having the protective cap 37 are coupled together, the brush 30 does not move inside of the body or bump against the body 10 during carrying the cosmetic case, so that there are not any noise and breakage.

Additionally, the cosmetic case according to the present invention prevents the cosmetic material contained in the body from being polluted by the brush 30 stained with the cosmetic material. Especially, because the brush 30 stained with the cosmetic material is stored in the brush storage hole 14*a* in a state that the brush 30 is wrapped with the protective cap 37, it can be prevented that the cosmetic material makes an inlet of the brush storage hole 14*a* dirty or remains inside of the brush storage hole 14*a* or the remaining cosmetic material is spilled from the brush storage hole 14*a*.

As described above, the cosmetic case according to the present invention has a reduced manufacturing cost and the excellent durability, is convenient in use and prevents the contamination of the cosmetic material by the brush.

Furthermore, according to the present invention, since the hair part of the brush is removably inserted into the brush storage hole in the state that the hair part is wrapped with the protective cap, the hair part of the brush is protected from being wider or bending.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A cosmetic case comprising:

a body having a hollow portion formed at an upper portion thereof for containing a certain amount of cosmetic material and a brush storage hole formed inwardly at a lower portion thereof for storing a brush;

a cover hinged at one side on the upper portion of the body to open and shut the body, the cover having a transparent window located at the center thereof for displaying the inside of the body containing the cosmetic material and a grip insertion groove formed at the other side of the cover opposed to the hinged portion; and a brush having a protective cap for wrapping and protecting a hair part and a grip part, the protective cap moving back and forth wrapping the hair part and the grip part, the brush being stored in the brush storage hole of the body and collapsed at a portion thereof, the collapsed end of the brush being forcedly inserted into the grip insertion groove of the cover to couple the cover and the body.

2. The cosmetic case as claimed in claim 1, wherein the brush includes a lower grip part and an upper grip part, and the lower grip part has an end portion where the hair part is fixed and another end portion where the upper grip part for coupling the cover and the body is hinged, and wherein the protective cap of the brush moves back and forth wrapping the hair part and the grip part to protect the hair part when the brush is inserted into the brush storage hole.

3. The cosmetic case as claimed in claim 2, wherein the grip part has a guide groove formed longitudinally and the protective cap has a guide protrusion formed inside of the protective cap and inserted into the guide groove of the grip part to lead a straight movement of the protective cap.

* * * * *